US007091923B2

(12) United States Patent
del Rio Bocio et al.

(10) Patent No.: US 7,091,923 B2
(45) Date of Patent: Aug. 15, 2006

(54) HORN ANTENNA COMBINING HORIZONTAL AND VERTICAL RIDGES

(75) Inventors: Carlos del Rio Bocio, Navarra (ES); Ramón Gonzalo García, Navarra (ES); David Goñi Campian, Navarra (ES); Jorge Teniente Vallinas, Navarra (ES)

(73) Assignee: Universidad Publica de Navarra, Navarra (ES)

( * ) Notice: Subject to any disclaimer, the term of this patent is extended or adjusted under 35 U.S.C. 154(b) by 0 days.

(21) Appl. No.: 10/512,833

(22) PCT Filed: May 16, 2003

(86) PCT No.: PCT/ES03/00217

§ 371 (c)(1),
(2), (4) Date: Jul. 26, 2005

(87) PCT Pub. No.: WO03/100907

PCT Pub. Date: Dec. 4, 2003

(65) Prior Publication Data

US 2006/0044202 A1 Mar. 2, 2006

(30) Foreign Application Priority Data

May 24, 2002 (ES) ..... 200201264

(51) Int. Cl.
*H01Q 13/00* (2006.01)

(52) U.S. Cl. ..... 343/786; 343/772

(58) Field of Classification Search ..... 343/772, 343/786

See application file for complete search history.

(56) References Cited

U.S. PATENT DOCUMENTS

| | | | | |
|---|---|---|---|---|
| 4,106,026 | A | 8/1978 | Bui-Hai et al. | |
| 5,486,839 | A * | 1/1996 | Rodeffer et al. | 343/786 |
| 6,208,309 | B1 * | 3/2001 | Chandler et al. | 343/786 |
| 6,208,310 | B1 * | 3/2001 | Suleiman et al. | 343/786 |
| 6,320,554 | B1 * | 11/2001 | Yuanzhu | 343/786 |
| 6,396,453 | B1 * | 5/2002 | Amyotte et al. | 343/786 |
| 6,522,306 | B1 * | 2/2003 | Parrikar et al. | 343/786 |
| 6,771,225 | B1 * | 8/2004 | Tits | 343/786 |
| 6,972,728 | B1 * | 12/2005 | Brown et al. | 343/786 |
| 2002/0167453 | A1 * | 11/2002 | Kung et al. | 343/786 |

FOREIGN PATENT DOCUMENTS

| | | |
|---|---|---|
| FR | 2455803 A1 | 11/1980 |
| JP | 11355032 A | 12/1999 |

OTHER PUBLICATIONS

English Abstract of JP11355032 Published Dec. 24, 1999.

* cited by examiner

*Primary Examiner*—Tan Ho
(74) *Attorney, Agent, or Firm*—Ladas and Parry LLP

(57) ABSTRACT

A horn antenna combining horizontal and vertical corrugations. It is made up of two well differentiated parts, the first part being an antenna with horizontal corrugations, i.e. parallel to the axis of propagation, and a second part with vertical corrugations, i.e. transverse to the axis of propagation. The aperture of the arrangement of the corrugations, in the two parts, can preferably follow linear or Gaussian functions.

8 Claims, 2 Drawing Sheets

HORN ANTENNA COMBINING HORIZONTAL AND VERTICAL RIDGES

This application is a 371 of PCT/ES03/00217 filed on May 16, 2003.

Horn antenna combining horizonal and vertical corrugation.

SECTOR OF THE ART TO WHICH INVENTION REFERS

The component presented is encompassed within electromagnetic systems for guiding energy at millimeter wave and microwave frequencies, and optimally adapts any electromagnetic field structure present inside a waveguide with a Gaussian structure.

PRIOR STATE OF THE ART

Currently, applications are more demanding with regard to the performances the antennas included in the telecommunication systems must comply with, whether they are land links or links via satellite.

Smaller and smaller levels of side lobes are required, since, in short, they imply an effective loss of power in the desired radiation direction. At the same time, and due to the large demand of services, it becomes necessary to reuse frequencies using polarization diversity to differentiate two signals. This fact generates a great interest in having very low cross polarization levels, which, in short, is the measure of isolation between these two possible signals at the same frequency using different polarization.

In addition to these two electromagnetic aspects, and since in the majority of cases this type of antennas must be borne by satellites, the size these antennas can have is also an important parameter.

Usually, good radiation features corresponding to electromagnetic impositions, could be achieved by means of the use of shorter corrugated antennas, whether they have Gaussian profiles (R. Gonzalo, J. Teniente and C. del Rio, "Very Short and Efficient Feeder Design for Monomode Waveguide", *Proceedings IEEE AP-S International Symposium*, Montreal, Canada, July 1997; C. Del Rio, R. Gonzalo and M. Sorolla, "High Purity Beam Excitation by Optimal Horn Antenna", *Proceedings ISAP'96*, Chiba, Japan), or another type of already known and widely used design techniques (A. D. Olver, P. J. B. Clarricoats, A. A. Kishk and L. Shafai, "Microwave Horns and Feeds", *IEE Electromagnetic waves series* 39, The Institution of Electrical Engineers, 1994, and A. W. Rudge, K. Milne, A. D. Olver and P. Knight, "The Handbook of Antenna Design", *IEE Electromagnetic waves series* 15 *and* 16. The Institution of Electrical Engineers, 1982).

The main drawback of the corrugated horn antennas used until today is that abrupt changes of the internal radius imply a significant reduction of the performances of the antennas. This forces having antennas with smooth flare angles, which gives way to long profiles, whether they are linear or not.

Furthermore, a corrugation depth matchmaker, in the form of an impedance match-making unit, must be incorporated in the first part of the corrugated horn antennas, the first corrugations necessarily having a depth somewhat greater than the aperture radius, matching the smooth circular guide aperture radius. The fact that the component has these deep corrugations at the beginning complicates the manufacturing process.

The present invention provides a competitive solution from two points of view: the electromagnetic and geometric points of view. Furthermore, since it does not contain vertical corrugations near the aperture (where the internal radius is smaller), it allows a much simpler manufacture, which could be carried out by means of machining with a simple numerical control machine.

EP 0 079 533 discloses a corrugated horn with conical cross-section having horizontal corrugations parallel to the axis of the propagation.

EXPLANATION OF THE INVENTION

The aperture of this type of antennas must match a transmission guide of the monomode smooth circular waveguide type, the only possible mode of which, known as fundamental, is $TE_{11}$.

The present invention consists in an antenna comprising horizontal corrugations at the aperture which present no mechanical complication, being able to noticeably increase in that first part the internal radius of the antenna in a very short length. Usually, in addition to increasing the internal radius of the antenna, it is necessary to advance lengthwise. However, according to the specific application, a first part with horizontal corrugations which did not advance at all in the axis of revolution is also possible, i.e. the radius increased at no expense whatsoever with regard to the length of the device.

This design of the first part of the antenna achieves a distribution of fields in a greater radius than that of the aperture guide, with more or less defined radiation features, and with a certain resemblance to a distribution of the field transversal to the propagation of the Gaussian type.

The antenna design object of the invention comprises a second section with vertical corrugations, preferably, but not necessarily, defined according to a Gaussian profile. It is thus possible to improve the radiation features of the first section of the antenna until generating a fundamental Gaussian beam of a purity exceeding 99%.

The depth of both the horizontal and vertical corrugations can be kept constant, or it can vary along the axis of revolution of the device.

The result is the practical disappearance of side lobes, together with a very low cross polarization. On the other hand, the length of the antenna thus designed is much smaller than other antennas designed with traditional techniques of similar electromagnetic performance.

DESCRIPTION OF THE DRAWINGS

To better understand the description, two drawings are attached which, only as an example, show one practical embodiment of the antenna combining horizontal and vertical corrugations.

EMBODIMENT OF THE INVENTION

To see a specific embodiment of this type of antennas, the monomode circular waveguide type, starting from the fundamental mode, $TE_{11}$, is focused on.

Figure 1:
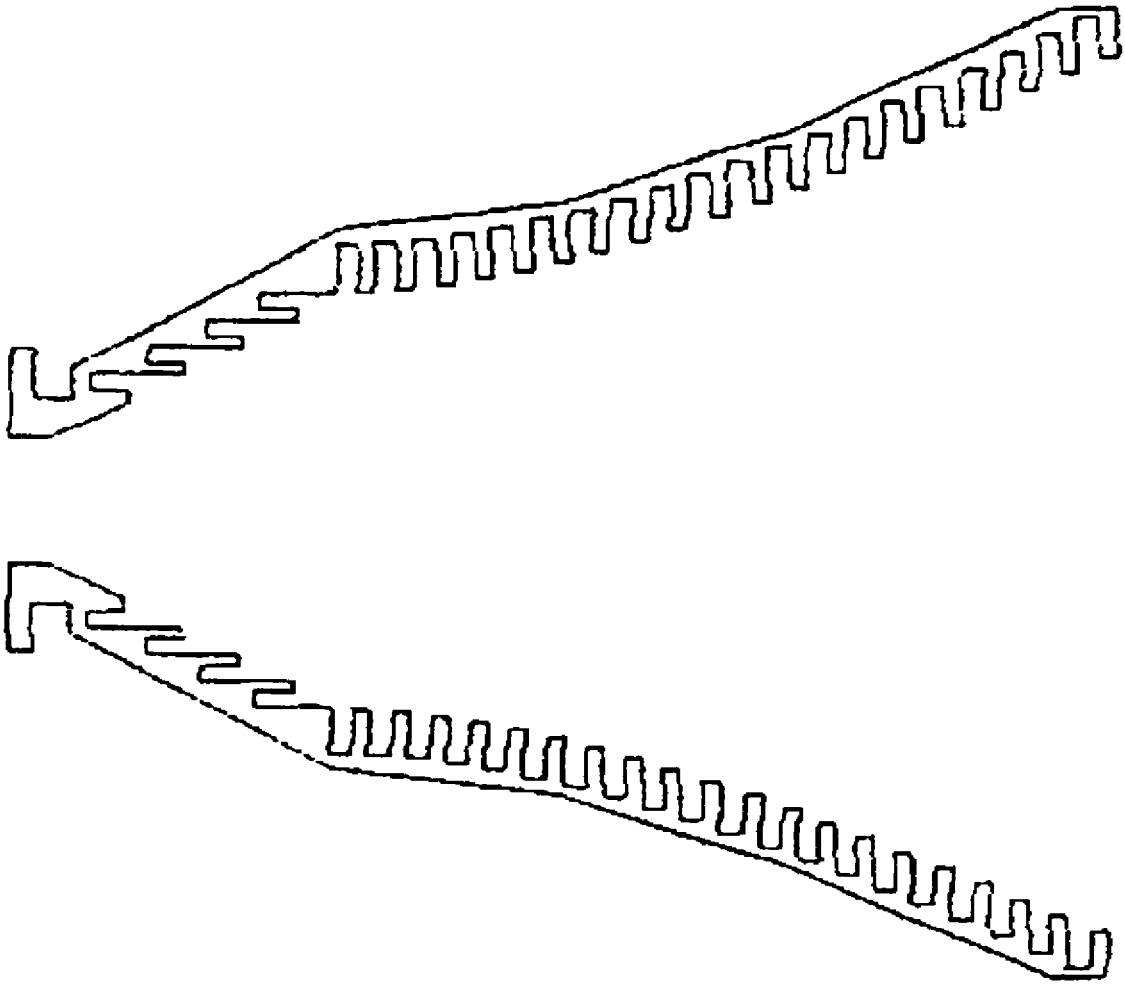
FIG. 1 shows a longitudinal sectional view of an antenna with horizontal and vertical corrugations. The component has symmetry of revolution according to the horizontal axis, it is therefore completely defined with this single sectional view.

As indicated, FIG. 1 shows a cross sectional view of this type of antennas, where horizontal corrugations (corrugations parallel to the axis of propagation), in this case defined according to a line, can be seen in the first part; and a second part with vertical corrugations (corrugations transversal to the propagation) defined with, in this case, a Gaussian profile antenna section, can be seen.

The frequency of this specific design is f=9.65 GHz, and total antenna length is 194 mm (6.2 wavelengths, λ=c/f=31 mm, where c=3*10^8 is the speed of light in free space). The aperture radius is 11.7 mm, and the output radius is 81.2 mm.

The horizontal corrugations have a 5 mm period with a 2 mm tooth width and 7 mm depth. The vertical corrugations have a 7 mm period, a 3 mm tooth width and 8.8 mm depth.

The first section has the corrugations distributed according to a linear function with a slope of 25°.

The second section is defined by a Gaussian function of the type:

$$r(z) = r_0\sqrt{1+\left(\frac{\lambda z}{2\pi\alpha_0^2}\right)^2} \tag{1}$$

with α=0.725, where $r_0$ is the radius of connection of the two parts, approximately 39 mm, and λ is the previously defined wavelength of 31 mm.

Figure 2:
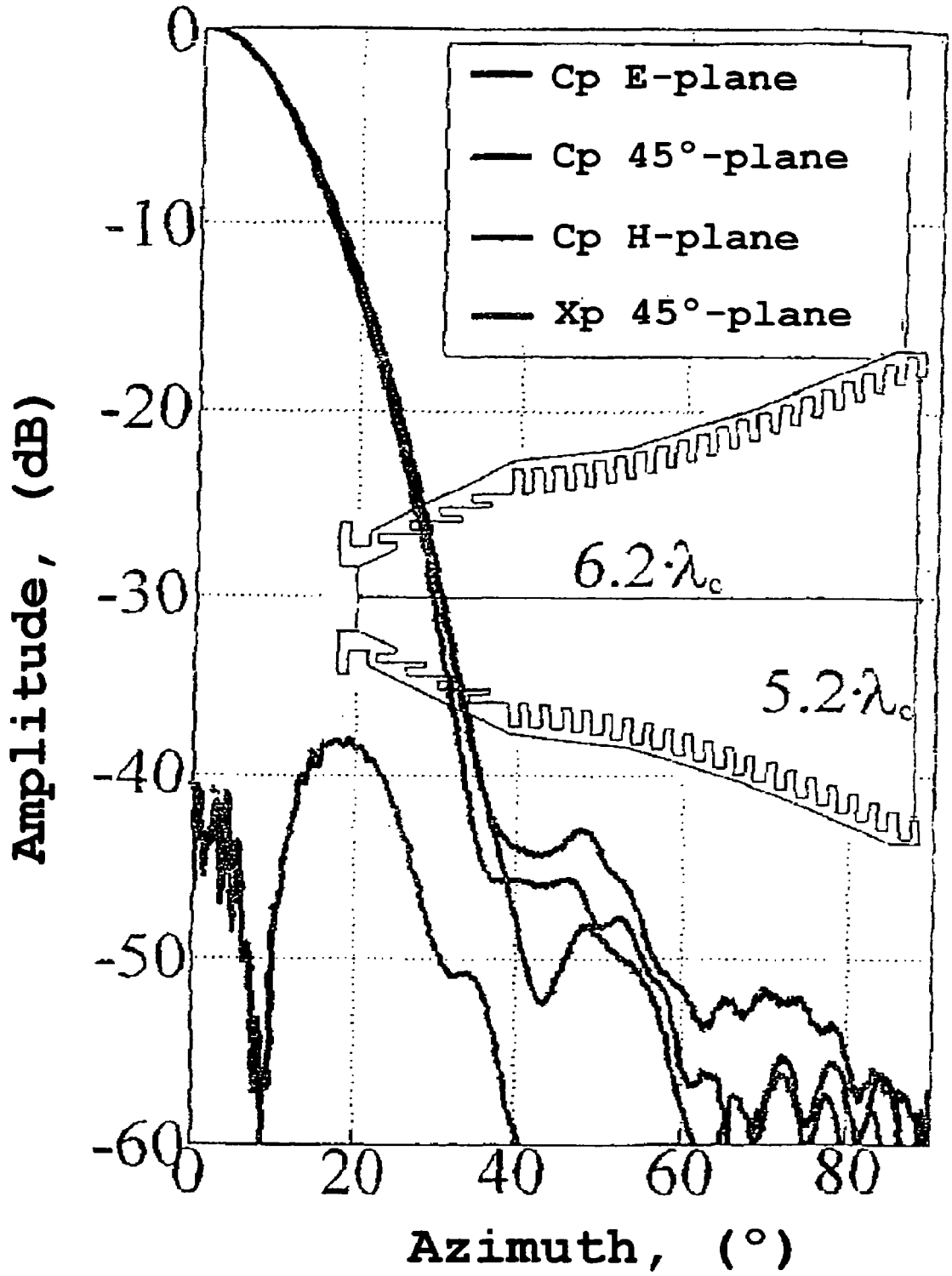
FIG. 2 shows the measured radiation diagrams of the antenna corresponding to FIG. 1, in the copolar sections of E, H and 45° Plane, and the maximum contrapolar component section corresponding to 45°. Just as the antenna has a symmetry of revolution, the diagrams also have this same symmetry, with the exception that, due to the representation, in this case the axis of revolution would correspond to the y-axis (the left-hand vertical axis of the graph).

The radiation features of this antenna, defined by these parameters and dimensions, are shown in FIG. 2. The reduced side lobe level, under 40 dB with regard to the maximum, as well as the cross polarization, can be seen.

Applications

This new type of antennas is especially applicable in the field of both space and land telecommunications since they are fairly short and light antennas with excellent radiation features.

Traditional horn antennas, which would be directly exchangeable for those presented herein, are currently used in a multitude of communications applications using microwave and millimeter wave band frequencies, improving the electromagnetic performances of the antennas, at the same time decreasing the size and total weight of the overall system.

The invention claimed is:

1. A corrugated horn antenna whose fundamental mode is TE11 for circular waveguide, characterised in that the horn antenna is configured such that a first part with horizontal corrugations parallel to the axis of propagation is followed by a second part with vertical corrugations transversal to the axis of propagation to provide substantially a fundamental Gaussian beam at the end of the horn antenna.

2. The corrugated horn antenna according to claim 1; characterized in that the horizontal corrugations of the first part are arranged from the beginning to the end of this part according to a linear function, such that the ratio between the radial distance of each horizontal corrugation and its horizontal position remains constant.

3. The corrugated horn antenna according to claim 2; characterized in that the vertical corrugations of the second part are arranged from the beginning to the end of this part according to a linear function, such that the ratio between the radial distance of each horizontal corrugation and its horizontal position remains constant.

4. The corrugated horn antenna according to claim 2; characterized in that the vertical corrugations of the second part are arranged from the beginning to the end of this part according to a non-linear function describing the propagation of the fundamental Gaussian beam through the second part.

5. The corrugated horn antenna according to claim 2; characterized in that the vertical corrugations of the second part are arranged from the beginning to the end of this part according to the equation, $$r(z) = r_0\sqrt{1+\left(\frac{\lambda z}{2\pi\alpha r_0^2}\right)^2}$$

where α is a parameter controlling the maximum slope of the converter, $r_0$ is the input radius of this second part of the antenna, and lambda is the wavelength, calculated according to the working frequency by means of the ratio $$\lambda = \frac{c}{f}$$

where $f$ is the working frequency and c is the light velocity in the vacuum or inside the material filling the horn antenna.

6. The corrugated horn antenna according to claim 1; characterized in that the horizontal corrugations of the first part are arranged from the beginning to the end of the first part according to a non-linear function describing the propagation of the fundamental Gaussian beam through the first part.

7. The corrugated horn antenna according to claim 1; characterized in that the horizontal corrugations of the first part are arranged from the beginning to the end of this part according to the equation, $$r(z) = r_0\sqrt{1+\left(\frac{\lambda z}{2\pi\alpha r_0^2}\right)^2}$$

where α is a parameter controlling the maximum slope of the converter, $r_0$ is the input radius of the antenna, and λ is the wavelength, calculated according to the working frequency by means of the ratio $$\lambda = \frac{c}{f}$$

where $f$ is the working frequency and c is the light velocity in the vacuum or inside the material filling the horn antenna.

8. The corrugated horn antenna according to claim 1; characterised in that the depth of the horizontal and vertical corrugations varies along the axis of propagation of the horn antenna.

* * * * *